US005174800A

United States Patent [19]

Schwilling et al.

[11] Patent Number: 5,174,800

[45] Date of Patent: Dec. 29, 1992

[54] ACTIVATED CARBON RADON ADSORPTION FOR BUILDINGS

[76] Inventors: Stephen F. Schwilling, 3110 E. Overland Rd., Meridian, Id. 83642; Joseph T. Foldyna, 1088 Saratoga Dr., Boise, Id. 83706

[21] Appl. No.: 805,589

[22] Filed: Dec. 11, 1991

[51] Int. Cl.[5] ..... B01D 53/04

[52] U.S. Cl. ..... 55/316; 55/387; 55/524

[58] Field of Search ..... 52/169.1, 169.14, 309.8, 52/309.9; 55/66, 74, 387, 316, 522, 524

[56] References Cited

U.S. PATENT DOCUMENTS

| | | | |
|---|---|---|---|
| 2,206,705 | 7/1940 | Newman | 55/387 X |
| 2,423,702 | 7/1947 | Hart | 55/387 X |
| 3,217,471 | 11/1965 | Silverman | 55/387 X |
| 3,538,020 | 11/1970 | Heskett et al. | 55/387 X |
| 3,630,007 | 12/1971 | Neumann | 55/387 |
| 3,721,072 | 3/1973 | Clapham | 55/387 |
| 3,865,758 | 2/1975 | Yoshida et al. | 55/387 X |
| 3,925,248 | 12/1975 | Moroni et al. | 55/387 X |
| 4,046,939 | 9/1977 | Hart | 55/387 X |
| 4,620,398 | 11/1986 | Wallin | 52/169.1 |
| 4,664,683 | 5/1987 | Degen et al. | 55/387 |
| 4,684,381 | 8/1987 | Wasylyniuk | 55/387 X |
| 4,756,724 | 7/1988 | Yuill | 55/66 X |
| 4,800,190 | 1/1989 | Smolik | 55/387 X |
| 4,830,643 | 5/1989 | Sassa et al. | 55/387 X |
| 4,869,832 | 9/1989 | Lamarre | 55/66 X |
| 5,002,596 | 3/1991 | Moskaitis et al. | 55/387 |

*Primary Examiner*—Robert Spitzer

*Attorney, Agent, or Firm*—Frank J. Dykas; Craig M. Korfanta; Ken J. Pedersen

[57] ABSTRACT

The invention is a radon gas adsorber for buildings which comprises an open-cell material containing activated carbon and attached to a backing material providing high resistance to radon gas flow. The adsorber, which traverses the bottom of the building, prevents entry of radon gas into the building from the ground below it by resisting the gas path with the backing material and adsorbing the gas with the activated carbon.

19 Claims, 3 Drawing Sheets

ACTIVATED CARBON RADON ADSORPTION FOR BUILDINGS

BACKGROUND OF THE INVENTION

1. Technical Field

This invention relates to building construction and to radon control for buildings. Specifically, it relates to a radon gas adsorber for buildings which comprises an open-cell material containing activated carbon and attached to a backing material providing high resistance to radon gas flow. The adsorber prevents flow of radon gas into the building from the ground below it by resisting the gas flow path with the backing material and adsorbing the gas with the activated carbon.

2. Background Art

The threat to health from radon gas in buildings is well known. (See, for example: *Radon: The Invisible Threat,* M. Lafavore, Rodale Press, 1987, and Radon: *A Homeowner's Guide to Detection and Control,* B. L. Cohen and D. Nelson, Consumers Union, 1987). Radon in indoor air comes primarily from radium in the soil. Radon is a gas which flows up from the soil into buildings. It is a dangerous vehicle for the dispersion of its shortlived radioactive decay products. Sources of radon infiltration may be very localized, like cracks and seams in basement floors and walls, and drains. However, radon may infiltrate buildings through the pores of concrete foundations and wood floors.

In the building trades, artisans have addressed the radon infiltration problem in several ways. Small fans have been used to provide subfloor ventilation for soil gas dilution and removal before entry into the building (See, for example: *JAPCA* 39: 305–309 (1989) R. Bocanegra and P. K. Hopke, "Theoretical Evaluation of Indoor Radon Control Using a Carbon Absorption System"). However, the success of this approach is limited to buildings with a low rate of air exchange between the foundation soil and the inside of the building.

Also, exposed earth and sump systems have been covered with impermeable materials, such as sheet metal. And, noticeable cracks and other openings, such as floor-to-wall seams and seams around drains, have been plugged with polymeric sealants. However, the effectiveness of this approach is uncertain, due to the difficulty of identifying and accessing all the infiltration routes.

Also, sub-slab and sub-floor vapor barriers of polyethylene or PVC have been used to block the infiltration path of soil gases. However, these barriers are subject to damage and puncture from rough sub-slab aggregates and from the comings and goings of workmen, reducing their effectiveness.

Also, it is well known that radon may be adsorbed with activated carbon (See, for example, *International Geology Review,* Vol. 12, No. 7, 873–878 (1967) Y. T. Kapitanov, I. V. Pavlov, N. P. Semikin and A. S. Serdyukova, "Absorption of Radon on Activated Carbon"). And, activated carbon has been included in air filters for adsorbing other gases (See, for example, U.S. Pat. Nos. 4,514,197, 4,793,837, 4,830,643 and U.S. Pat. No. 4,906,263).

However, there is still a need in the building industry for a radon gas adsorber which is durable, effective and safe.

DISCLOSURE OF INVENTION

What we have invented is:

a radon gas adsorber for buildings which comprises:

a sheet comprising an open-cell material containing activated carbon and attached to a backing material providing high resistance to radon gas flow, said sheet traversing the bottom of a building between said building's foundation soil and its habitation areas, and said sheet being oriented so that the open-cell material is in the down direction, and the backing material is in the up direction.

the open-cell material is rubber;

the open-cell material is a synthetic, polymeric material;

the activated carbon is powdered;

the activated carbon is granulated;

the sheet lies on top of the building's foundation;

the sheet is attached to the bottom of a floor's sub-flooring;

the sheet is attached to the top of a floor; and, the sheet is of a plurality of pieces connected together.

Also, we have invented:

a broad, relatively thin sheet comprising an open-cell material containing activated carbon and attached to a backing material providing high resistance to radon gas flow.

Also, our invention includes the sheet above wherein:

the open-cell material is rubber;

the open-cell material is a synthetic, polymeric material;

the activated carbon is powdered;

the activated carbon is granulated;

the open-cell material is a layer between about $\frac{1}{8}$ and $\frac{3}{4}$ inches thick;

backing material is a layer between about 1/100 and $\frac{1}{4}$ inch thick;

The sheet is rectangular in shape;

The sheet is about 3 feet wide and about 50 feet long; and,

From the use of our invention, a durable, effective and safe radon gas adsorber is provided for the building industry.

BEST MODE FOR CARRYING OUT INVENTION

Referring to the Figures, there is depicted generally our radon adsorber sheet 10 with an open-cell material 11 and an attached backing material 12. The open-cell material 11 contains powdered or granulated activated carbon particles 13 distributed uniformly throughout it.

The sheet is a broad, relatively thin piece comprising a layer of open-cell material containing activated carbon, attached to a layer of backing material providing high resistance to radon gas flow. The perimeters of the open-cell material and the backing material should be coterminous. Preferably, both the open-cell material and the backing material are flexible.

Generally, the open-cell layer is thicker than the backing material layer. We prefer the open-cell material to be a layer between about $\frac{1}{8}$ and $\frac{3}{4}$ inches thick, the thicker layer providing more absorption capacity for a given concentration of activated carbon. We prefer the backing material to be a layer between about 1/100 and $\frac{1}{4}$ inch thick, the thicker layer providing more durability for a given strength of backing material.

It is essential that the open-cell material and the backing material be attached together so that our absorber sheet is a unitary piece. This way, it is assured that the radon gas, when its upward flow is resisted by the backing material and it is slowed or stopped, is in the immediate vicinity of activated carbon in the open-cell material for adsorption in the adsorber sheet. The open-cell material and the backing material may be attached together with a suitable adhesive which does not interfere with the absorption characteristics of the activated carbon. Or, they may be attached or formed together during manufacture.

Usually, our sheet will be manufacturered in rectangular pieces. They may be long, narrow rolls about 3 feet wide and about 50 feet long, or about 42 inches wide and 100 feet long, for example. These pieces may be rolled up and handled easily, being unrolled and fastened into place in sealed, overlapping fashion for installation. Or, out sheet may be manufacturered as square mats about 50 feet wide and about 50 feet long, for example. These pieces may be handled flat or folded, being installed in one piece.

Figure 1:
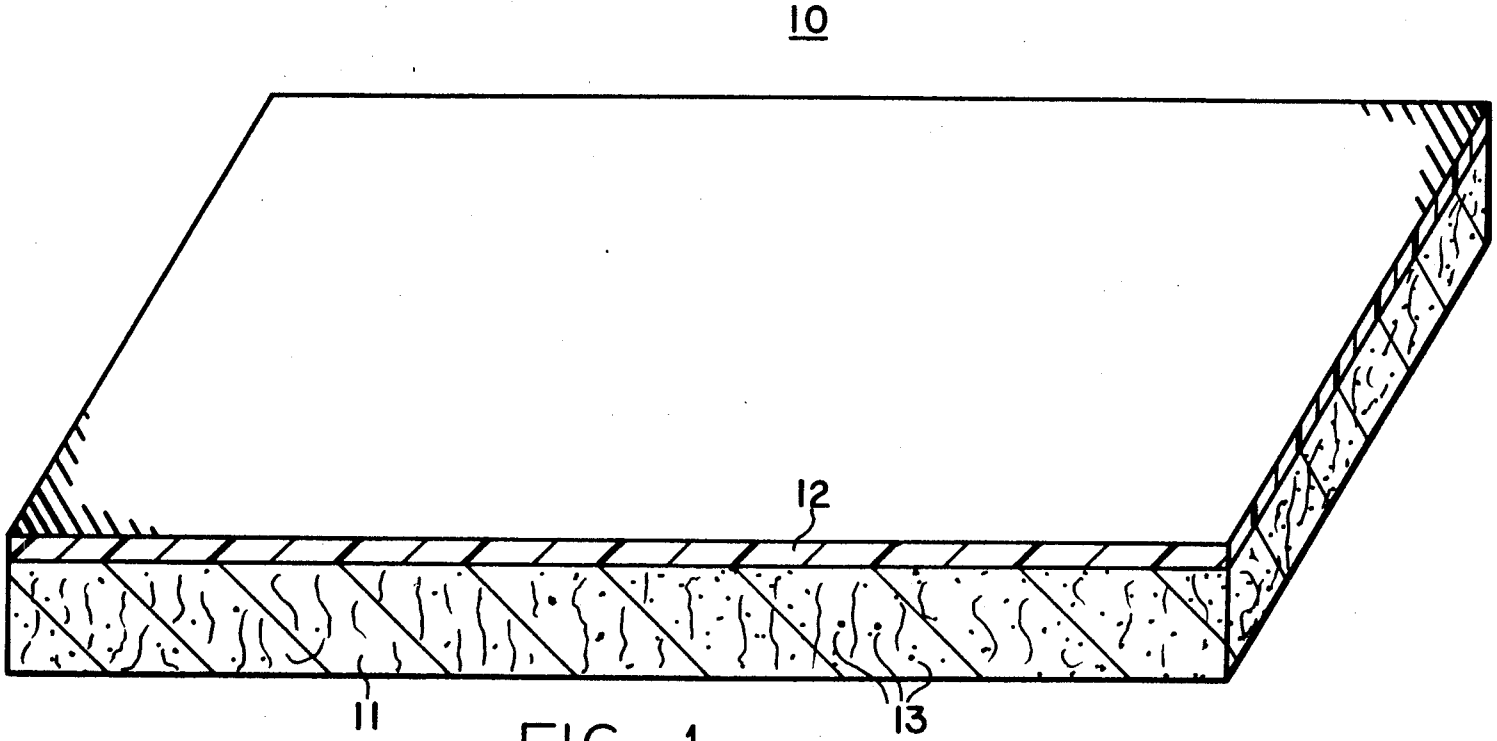
FIG. 1 is a perspective view of the radon gas adsorber sheet of our invention.
Figure 2:
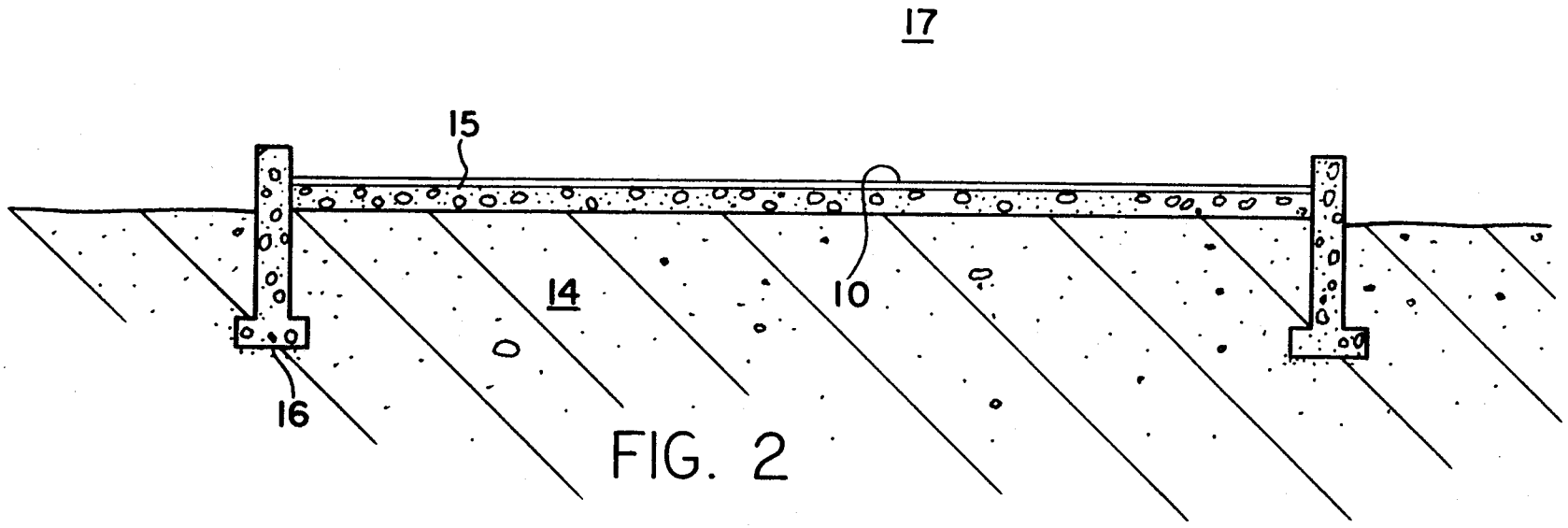
FIG. 2 is an elevational, cross-sectional view of our one-piece radon adsorber lying directly on top of a basement slab.

We use our absorber sheet by placing it entirely across the bottom of the building beneath the lowest habitation area. In FIG. 2 there is depicted an elevation, cross-sectional view of our sheet 10, foundation soil 14, basement slab 15, foundation footings 16 and habitation area 17. In this embodiment, out absorber sheet 10 is lying directly on top of basement slab 15. A carpet or carpet pad may be laid on top of our sheet. Our sheet 10 is oriented so that the open-celled material is in the down direction, towards the foundation soil 14, which is the source of the radon gas. This way, radon gas is allowed to pass into the open cells and be absorbed there by activated charcoal. Also, our sheet 10 is oriented so that the backing material 12 is in the up direction, towards the habitation area 17. This way, radon gas is not allowed up past the open-celled material 11, and is not allowed to infiltrate into habitation area 17. In addition, if the sheet 10 becomes torn from damage or wear, the presence of the activated carbon in the vicinity of the tear will act to minimize infiltration of the radon by absorption of the radon gas there.

Our absorber sheet works best under very low, or no, flow conditions. This is because radon absorption on activated carbon is effective only at superficial velocities in the range below bout 0.0002 m/sec. The high resistance to radon gas flow feature of the backing of our sheet acts to stop or to slow the upward movement of radon gas, and, at these very low, or non, flow conditions, the radon, and its decay products, is completely absorbed by the activated carbon. We calculate an effective life of at least 50 years for an adsorber sheet containing at least 8 grams per square foot activated carbon with adsorption surface of at least 1000 square meters per gram.

In order to achieve these very low, or no, flow conditions, however, ventilation of the soil gas must be eliminated. Subfloor and crawl space vents must be closed. This approach is contrary to the most common approach before our invention for controlling radon in buildings exhausting or venting the soil gas.

In FIG. 2, our adsorber sheet 10 lies on top of the foundation or basement slab 15. In another embodiment not described in the drawings, the sheet lies on top of the foundation beneath a floor's sub-flooring. Also, in another embodiment not described in the drawings, the sheet may be installed on top of building floors. In these embodiments, care must be exercised to eliminate also other avenues of radon ingress into the habitation area, but if our sheet is installed to seal the floor and the floor-to-wall junctions, radon ingress will be minimized. In these embodiments, we prefer the barrier sheet be one piece. This way, it may be quickly, easily, and inexpensively installed.

Figure 3:
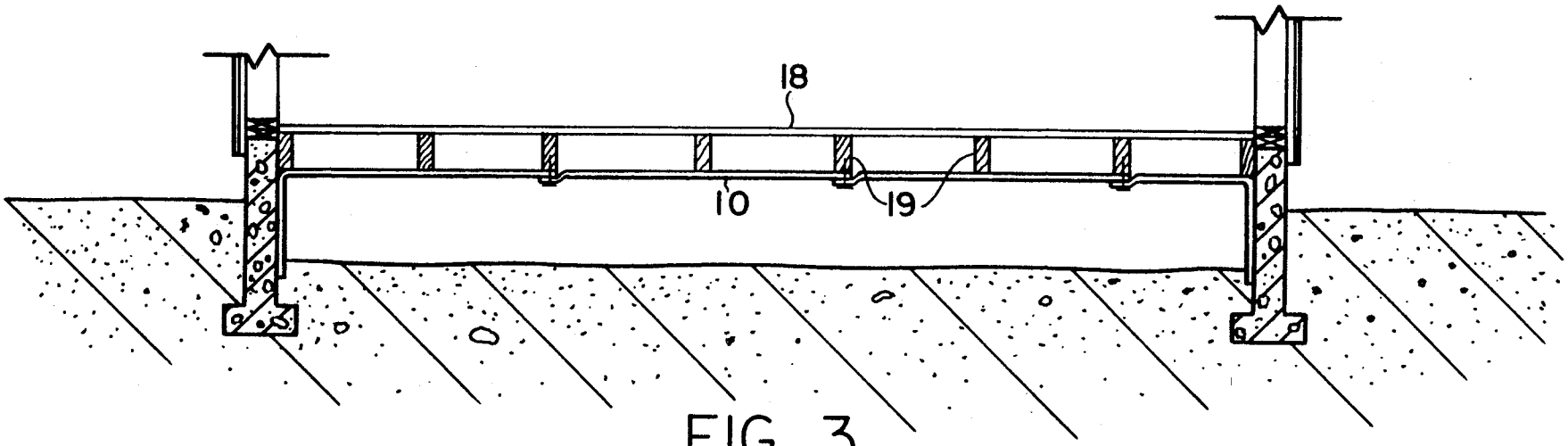
FIG. 3 is an elevational cross-sectional view of our plurality-piece radon adsorber attached to the bottom of a floor's sub-flooring.

In FIG. 3, our adsorber sheet 10 is attached to the bottom of a floor's 18 sub-flooring 19. In this embodiment, we prefer the barrier sheet be a plurality of pieces connected together. This way, they may be conveniently carried underneath the floor where space to work may not be ample. The workmen must be careful to ensure that the seams where the pieces overlap are tightly sealed to prevent infiltration paths for the radon gas.

Regarding our adsorber sheet, it comprises an open-cell rubber or synthetic material containing powdered or granulated activated carbon. The open-cell material must permit the passage of soil gases for adsorption. Also, the open-cell material must serve as the framework for supporting the activated carbon particles. These particles may be uniformly mixed with the open-cell material precursor prior to making the open-cell material. Or, they may be added, by impregnation from a solution, for example, to the open-cell material after it is formed.

The activated carbon may be a powdered or granulated form. Activated carbon is characterized by a very large surface area per unit volume, due to its very large number of fine pores, which serve as gas adsorption sites. We prefer as much activated carbon be added to the open-cell material as possible, to maximize adsorption life, within the limit of the open-cell material's ability to support the added carbon, and within the limit of the open-cell material's ability to permit the passage of soil gases after the carbon is added.

Regarding the backing material, it may be any composition which provides high resistance to the passage of soil gases, and which may be made in a sheet form. Also, the backing material must be able to bind effectively with the open-cell material so they may be combined to produce an integral sheet. The backing material must be a closed cell type material, and bonded to the open-cell material.

Our adsorber sheet traverses the bottom of a building between the building's foundation soil and its habitation areas. By "traverses" we mean, in a plane perpendicular to the height of the building, the adsorber sheet covers entirely the bottom of the building's habitation area. This way, our sheet can act as a resistor/adsorber to the radon gas infiltration path, which is generally up from the building's foundation soil toward the habitation areas.

While there is shown and described the present preferred embodiment of the invention, it is to be distinctly understood that this invention is not limited thereto but may be variously embodied to practice within the scope of the following claims.

We claim:

1. A radon gas adsorber for a building with a foundation located above foundation soil and beneath the habitation areas of said building, which comprises:

a sheet comprising an open-cell material containing activated carbon and attached to a backing material providing high resistance to radon gas flow, said sheet transversing the bottom of said building between said foundation soil and said habitation areas, and said sheet being oriented so that the open-cell material is in the down direction, and the backing material is in the up direction.

2. The adsorber of claim 1 wherein the open-cell material is rubber.

3. The adsorber of claim 1 wherein the open-cell material is a synthetic, polymeric material.

4. The adsorber of claim 1 wherein the activated carbon is powdered.

5. The adsorber of claim 1 wherein the activated carbon is granulated.

6. The adsorber of claim 1 wherein the sheet lies on top of the building's foundation.

7. The adsorber of claim 1 wherein the sheet is attached to the bottom of a floor's sub-flooring.

8. The adsorber of claim 1 wherein the sheet is attached to the top of a floor.

9. The adsorber of claim 1 wherein the sheet is of a plurality of pieces connected together.

10. A broad, relatively thin sheet comprising an open-cell material containing activated carbon and attached to a backing material providing high resistance to radon gas flow.

11. The sheet of claim 10 wherein the open-cell material is rubber.

12. The sheet of claim 10 wherein the open-cell material is a synthetic, polymeric material.

13. The sheet of claim 10 wherein the activated carbon is powdered.

14. The sheet of claim 10 wherein the activated carbon is granulated.

15. The sheet of claim 10 wherein the open-cell material is a layer between about $\frac{1}{8}$ and $\frac{3}{4}$ inches thick.

16. The sheet of claim 10 wherein the backing material is a layer between about 1/100 and $\frac{1}{4}$ inch thick.

17. The sheet of claim 10 which is rectangular in shape.

18. The sheet of claim 17 which is about 3 feet wide and about 50 feet long.

19. The sheet of claim 17 which is about 50 feet wide and about 50 feet long.

* * * * *